United States Patent [19]

Smith

[11] Patent Number: 4,996,396

[45] Date of Patent: Feb. 26, 1991

[54] FLOW SWITCH

[75] Inventor: Ronald J. Smith, Shelton, Conn.

[73] Assignee: Imo Industries, Inc., Princeton, N.J.

[21] Appl. No.: 428,933

[22] Filed: Oct. 30, 1989

[51] Int. Cl.[5] ..... H01H 35/38

[52] U.S. Cl. ..... 200/81.9 M; 200/82 E

[58] Field of Search ..... 200/81.9 M, 81.9, 82 E

[56] References Cited

U.S. PATENT DOCUMENTS

| | | | |
|---|---|---|---|
| 2,963,563 | 12/1960 | Patterson | 200/81.9 M |
| 3,327,079 | 6/1967 | Widl | 200/81.9 M |
| 4,213,021 | 7/1980 | Alexander | 200/81.9 M |

*Primary Examiner*—Robert S. Macon

*Attorney, Agent, or Firm*—Hopgood, Calimafde, Kalil, Blaustein & Judlowe

[57] ABSTRACT

The invention contemplates a flow-switch construction of the straight flow-through variety wherein a magnet-bearing piston is displaced in response to a hydraulic-flow condition and in the displacement is caused to operate a magnetic-reed switch. The piston has piloted guidance in a first longitudinal portion of an elongate bore but is characterized by one or more straight channels in its periphery, whereby the piston per se constitutes relatively little restriction to flow; the downstream end of the piston carries a metering disc which substantially resists channel flow as long as the metering disc has predetermined close-clearance relation with the first longitudinal portion of the bore. Immediately downstream from the first longitudinal portion, the bore is substantially enlarged in a second longitudinal portion, whereby upon piston displacement such as to advance the metering disc into the second longitudinal portion, the metering disc is by-passed and unrestricted straight-through flow proceeds to the outlet end of the bore.

15 Claims, 1 Drawing Sheet

FLOW SWITCH

BACKGROUND OF THE INVENTION

The invention relates to a magnetically operated electrical switch construction which is responsive to hydraulic flow, and in particular the invention is concerned with the single-direction or straight flow-through variety of such devices.

Many types of flow switches have been proposed and marketed within the past few years. Those units which incorporate flow-through capability have utilized a magnet-bearing piston in the flow stream; in some configurations the involved flow of hydraulic fluid is allowed to exit at a right angle to the direction of inlet flow, and in other configurations, the flow is either through or around the piston, in order that inlet and exit flows may be in the same direction. In the right-angle exit situation, the presence of a sufficient flow to actuate the device will displace the piston into a "bypass" location wherein there is at least some reduction in pressure drop across the unit. On the other hand, with the single-direction variety there has been no resulting reduction in pressure drop, however far the piston is displaced; this is because the piston remains in the fluid path, as a continuing restriction to flow through the unit.

BRIEF STATEMENT OF THE INVENTION

It is an object of the invention to provide an improved construction for a straight or single-direction flow-switch device of the character indicated.

A specific object is to meet the above object with a construction which will allow the involved piston to remain directly in the flow stream and yet to provide essentially no pressure drop for flows that are sufficient to actuate the device.

Another object is to provide basic simplicity of structural components and functional reliability in a device meeting the above objects.

The invention in a preferred embodiment achieves the foregoing objects in a straight flow-through construction wherein the piston has piloted guidance in a first longitudinal portion of an elongate bore but is characterized by one or more straight channels in its periphery, whereby the piston per se constitutes relatively little restriction to flow; the downstream end of the piston carries a metering disc which substantially resists channel flow as long as the metering disc has predetermined close-clearance relation with the first longitudinal portion of the bore. Immediately downstream from the first longitudinal portion, the bore is substantially enlarged in a second longitudinal portion, whereby upon piston displacement such as to advance the metering disc into the second longitudinal portion, the metering disc is by-passed and unrestricted straight-through flow proceeds to the outlet end of the bore.

DETAILED DESCRIPTION

The invention will be described in detail in conjunction with the accompanying drawings, in which.

Figure 1:
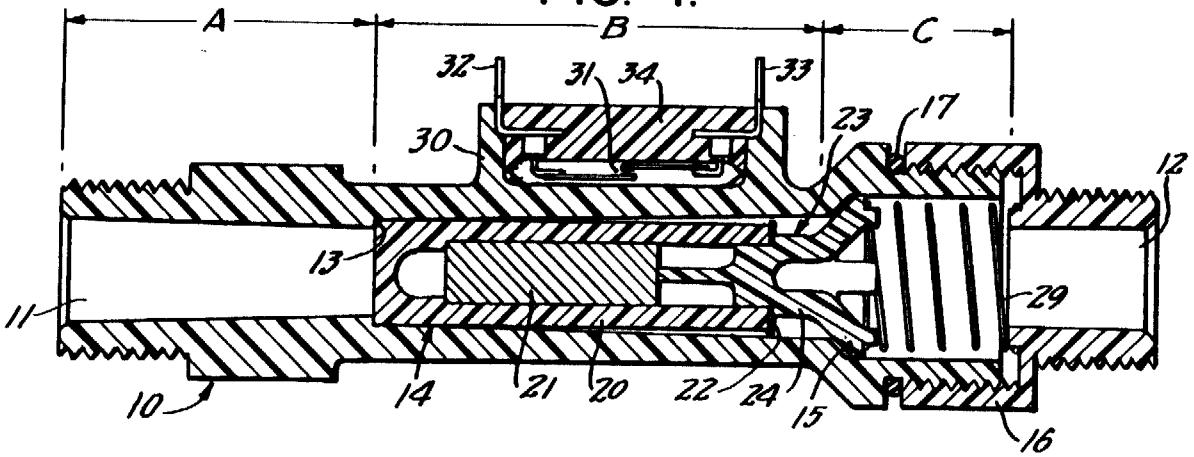
FIG. 1 is a view in longitudinal section through a flow-switch unit which is the preferred embodiment of the invention.

The flow-switch unit of FIG. 1 comprises a tubular body 10 of magnetically transparent material and having an elongate bore extending downstream between an inlet port 11 and an outlet port 12. For the purposes of the FIG. 1 embodiment, the bore may be said to comprise three longitudinal portions A, B, C, which are preferably generally cylindrical and of progressively expanding diameter. A stepped formation or shoulder 13 is defined at juncture of portions A and B, whereby to establish a seating or upstream limit of displaceability of a piston 14 that is guided by the longitudinal portion B; and a conically stepped or flared transitional region 15 is defined at juncture of portions B and C. The outlet port 12 is provided by the central opening of the otherwise closed end of a cap 16 that is threadedly engaged to the downstream end of body 10, and sealed by an elastomeric O-ring 17.

The body parts 10 and 16 may be injection-molded of the same material. Thus, in the molding process, a first core element may be slightly tapered and withdrawable via the inlet port (i.e., right-to-left withdrawable, in the sense of FIG. 1) to produce a gradual inward taper in portion A, to shoulder 13; and another core element may be similarly but oppositely tapered to define portions B and C, being withdrawable in the left-to-right direction. The thus-defined taper in portion B, e.g., divergent in the downstream direction, to the extent of a degree or less, is advantageous for the use of fluid flow to dispose of, and therefore not to accumulate, particulate matter in the hydraulic flow, as will become clear.

Figure 3:
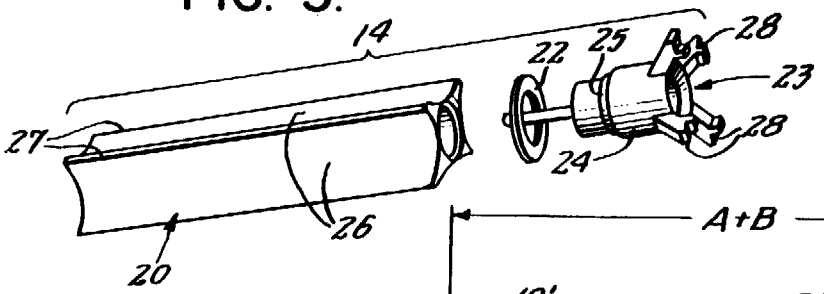
FIG. 3 is an exploded view in perspective of the downstream end of the piston in the embodiment of FIG. 1.

Piston 14 is seen in FIGS. 1 and 3 to be a subassembly of four parts—a piston-body part 20, a permanently magnetized core part 21, an annular metering disc 22 (as of brass), and a spider part 23. The parts 20, 23 may be injection-molded of the same material as the body parts 10, 16.

As seen in FIG. 1, the piston-body part 20 is elongate, with a bore which is closed at the upstream end and which is counterbored to define a seating shoulder for the inserted core part 21. The spider part 23 has a central hub 24 with a reduced land formation 25 which concentrically supports the metering disc 22 and which ultimately has bonded fit to the downstream end of the bore of the piston-body part 20; in this condition, disc 22 will be understood to be rigidly sandwiched between the shoulder of hub 24 and the adjacent end of piston-body part 20. Also, in this condition, an integrally formed upstream-projecting stem-like end of hub 24 firmly abuts the magnetic-core element 21, permanently retaining the same in its seated position.

Piston 14 is further described by identifying elongate flutings or channel formations 26 which extend the full length of piston-body part 20, at equal angularly spaced regions of the outer surface of part 20; as shown, there are four of these channel formations 26, whereby narrow ribs 27 (between adjacent channel formations) are the means of stabilized piston guidance in the body-bore portion B. Further, spider 23 is seen to integrally include four lug or finger formations 28 at equal angular spacings and extending radially outward into and in clearance relation with region C of the body bore; the finger formations 28 are seen to be notched for concentric location of a compressionally preloaded coil spring 29 which has referencing abutment with body part 16, whereby in the absence of a flow condition, piston 14 assumes and retains its seated upstream position of rest.

The finger formations 28 will be understood to be sufficiently spaced to allow at least the flow that is possible via the channel formations 26, thus making disc 22 the only restriction to initial flow through the bore of body 10. This restriction is determined by radial clearance between disc 21 and the bore of region B, and the desired flow requirement (set point) for the overall switch unit determines selection of a metering disc that is appropriate to establish predetermined radial clearance with the body-bore region B.

Description of the overall switch unit of FIG. 1 is completed by identifying a slot-like recess in an enlargement or bulging formation 30 in the outer profile of body 10. The recess of formation 30 is so located, within the longitudinal span B, as to receive and accurately locate a hermetically sealed magnetic-reed switch 31 with externally accessible outwardly extending electric-lead terminals 32, 33; the thus-located position of switch 31 is permanently retained by a potting 34 of epoxy or other suitable plastic material.

Figure 2:
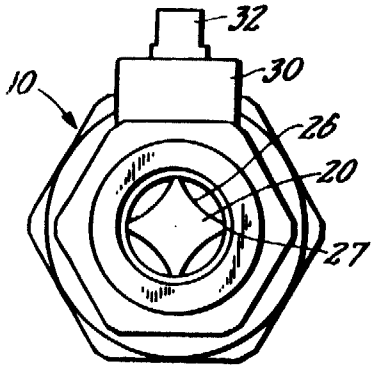
FIG. 2 is a left-end view of the embodiment of FIG. 1.
Figure 4:
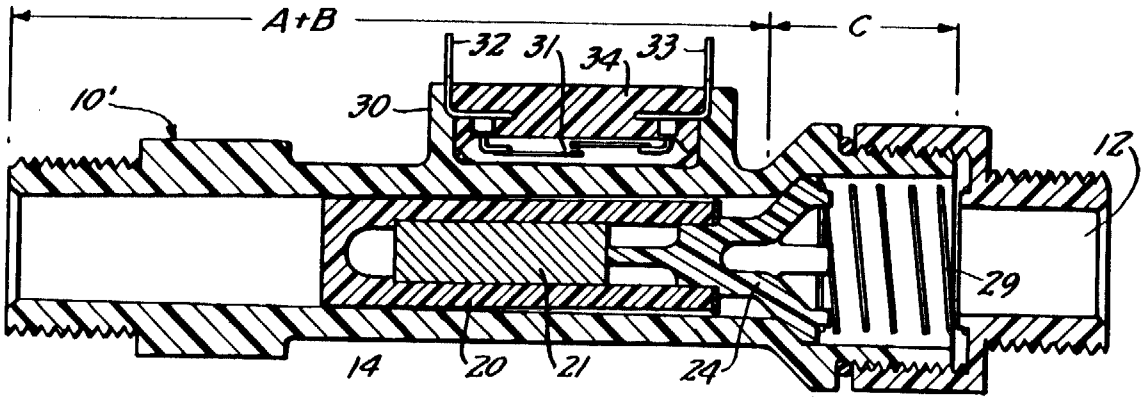
FIG. 4 is a view similar to FIG. 1, to show a modification.

The modification of FIG. 4 is similar to that which has been described for FIGS. 1 to 3, and therefore like reference numbers are used to identify corresponding parts. The principal difference in FIG. 4 is that there is no shoulder 13 for seating piston 14 in the no-flow condition. Rather, this seated position is determined upon seating abutment of spider fingers 28 with the transitional frusto-conical formation 15 between region C and the guidance bore for piston 14. The through-bore of body 10' in FIG. 4 thus comprises a first longitudinal bore region (A+B) and a second and expanded bore region C, and the slightly expanding taper described for region B of the bore of FIG. 1 may, for the purposes of FIG. 4, characterize the full length A+B, thus making for a less complex molding procedure for the body 10'.

In operation of the described flow switch embodiments, flow of hydraulic fluid (e.g., water) enters via inlet port 11, travels through the body and through the channels 26 along the sides of the piston body 20, and through the restricting clearance between the metering disc 22 and the body bore of region B. At the calibrated set point of the unit, the force of increasing fluid flow on the piston 14 overcomes the bias of spring 29, allowing the piston to displace its metering disc 22 into region C, i.e., toward outlet port 12. Since the piston carries magnet 21, piston displacement necessarily involves corresponding displacement of the field of the magnet, thus altering the field surrounding switch 31 sufficiently to allow the reed contacts of the switch to open or close as required.

Pressure drop through the flow switch is further reduced by the configuration shown and described for fingers 28. The total space between fingers 28 substantially exceeds the set-point determining clearance for the metering disc 22, for even the largest range of flows to be accommodated for a given size of piston 14 and body 10 (10'). The fingers 28 are further seen to be curved outwardly, in the downstream direction. After the flow passes the metering restriction, there is no further restriction, because of the greatly enlarged capacity of the space between fingers and because, once the metering disc clears the downstream end of region B, the flow can easily expand into the enlarged by-pass diameter of region C, and the flow can also pass easily around and between the fingers to later reconverge for exiting the device via the outlet port 12.

The described constructions will be seen to serve a variety of flow requirements for a given size of body 10 and piston 14, merely by suitable choice of outer diameter for the metering disc 22. For example, for a construction wherein the inlet and outlet bores are of 7/16 inch diameter, the set point for a 0.5 gallon/minute minimum flow is determined by a metering disc selected for about 0.004 in. radial clearance with the bore of region B when the piston is in its seated position; and the set point for a 5 gallons/-minute minimum flow is determined by a metering disc that is selected for about 0.055 in. radial clearance with the same bore.

What is claimed is:

1. A magnetically operated flow switch, comprising a tubular body of magnetically-transparent material and having an elongate bore extending downstream between an inlet port and an outlet port, a piston guided for longitudinal displaceability in a first longitudinal portion of said bore, said piston containing a permanent-magnet element and having at least one longitudinally continuous flow-channel formation in its outer surface, said bore having a second longitudinal portion that is downstream from said first longitudinal portion, said second longitudinal portion being enlarged with respect to said first longitudinal portion, and said bore being stepped between said first and second longitudinal portions, said piston having plural angularly spaced radially outward lug formations at its downstream end for limiting upstream displaceability of said piston beyond lug interference with the stepped portion of said bore, compressionally preloaded spring means retained within said second longitudinal portion and engaged to the downstream end of said piston to continuously urge the same toward a limit of upstream displaceability at lug engagement with the stepped portion of said bore, and a sealed magnetic-reed switch fixedly carried by said body at a longitudinal location having actuable relation to the field of said magnet in the course of its range of displaceability downstream from its said limit of upstream displaceability.

2. The flow switch of claim 1, in which said flow-channel formation is one of a plurality of flow-channel formations in angularly spaced relation.

3. The flow switch of claim 1, in which the stepped portion of said bore is a frusto-conical enlargement from the downstream end of said first longitudinal portion to the upstream end of the second longitudinal portion of said bore.

4. The flow switch of claim 1, in which said piston comprises a first part containing said magnet element and having said channel formation, and in which said lug formations are plural radially outward fingers integrally formed with a hub to define a second part having bonded connection to said first part.

5. The flow switch of claim 4, in which an annular metering disc is retained captive at the bonded connection of said hub to said first part.

6. The flow switch of claim 1, in which an annular metering disc is carried by said piston in upstream proximity to the downstream end of said first longitudinal portion, for the full range of piston displaceability.

7. The flow switch of claim 1, in which the first longitudinal portion of said bore is characterized by gradual expansion downstream from the location of the upstream end of said piston when at its said limit of upstream displaceability.

8. The flow switch of claim 1, in which said outlet port is defined in the otherwise-closed end of a cap fitted to said body at the downstream end of the second longitudinal portion of said bore, said spring being referenced to said body via the otherwise-closed end of said cap.

9. A magnetically operated flow switch, comprising a tubular body of magnetically transparent material and having an elongate bore extending downstream between an inlet port and an outlet port, said bore comprising progressively enlarged first, second and third longitudinal portions with a shoulder formation between said first and second portions, a piston containing a permanent-magnet element and having at least one longitudinally continuous flow-channel formation in its outer surface, said piston having a limit of upstream displaceability at seating engagement with said shoulder formation, compressionally loaded spring means retained within said third longitudinal portion and engaged to the downstream end of said piston to continuously urge the same toward said seating engagement, and a sealed magnet-reed switch fixedly carried by said body at a longitudinal location having actuable relation to the field of said magnet in the course of its range of displaceability downstream from its said limit of upstream displaceability.

10. The flow switch of claim 9, in which said flow-channel formation is one of a plurality of flow-channel formations in angularly spaced relation.

11. The flow switch of claim 9, in which said piston comprises a first part containing said magnet element and having said channel formation, and in which said lug formations are plural radially outward fingers integrally formed with a hub to define a second part having bonded connection to said first part.

12. The flow switch of claim 11, in which an annular metering disc is retained captive at the bonded connection of said hub to said first part.

13. The flow switch of claim 9, in which an annular metering disc is carried by said piston in upstream proximity to the downstream end of said first longitudinal portion, for the full range of piston displaceability.

14. The flow switch of claim 9, in which the second longitudinal portion of said bore is characterized by gradual expansion downstream from the location of the upstream end of said piston when at its said limit of upstream displaceability.

15. The flow switch of claim 10, in which said outlet port is defined in the otherwise-closed end of a cap fitted to said body at the downstream end of the third longitudinal portion of said bore, said spring being referenced to said body via the otherwise-closed end of said cap.

* * * * *